US011091912B2

(12) United States Patent
Divito

(10) Patent No.: US 11,091,912 B2
(45) Date of Patent: Aug. 17, 2021

(54) LINTEL COVER

(71) Applicant: Angle Armour Inc., Belle Ewart (CA)

(72) Inventor: Bruno Divito, Belle Ewart (CA)

(73) Assignee: Angle Armour Inc., Belle Ewart (CA)

( * ) Notice: Subject to any disclaimer, the term of this patent is extended or adjusted under 35 U.S.C. 154(b) by 0 days.

(21) Appl. No.: 16/705,050

(22) Filed: Dec. 5, 2019

(65) Prior Publication Data

US 2020/0248452 A1 Aug. 6, 2020

(30) Foreign Application Priority Data

Jan. 31, 2019 (CA) ..... CA 3031992
Sep. 30, 2019 (CA) ..... CA 3057127

(51) Int. Cl.
*E04C 3/02* (2006.01)

(52) U.S. Cl.
CPC ..... *E04C 3/02* (2013.01); *E04C 2003/023* (2013.01)

(58) Field of Classification Search
CPC ..... E04C 3/02; E04C 2003/023
See application file for complete search history.

(56) References Cited

U.S. PATENT DOCUMENTS

| | | | | |
|---|---|---|---|---|
| 3,605,356 A | | 9/1971 | Bordner | |
| 3,875,713 A | | 4/1975 | Laborde | |
| 4,019,301 A | | 4/1977 | Fox | |
| 4,280,308 A | | 7/1981 | Svensson | |
| 4,423,575 A | | 1/1984 | Lagergren et al. | |
| 5,222,345 A | * | 6/1993 | Riley | E06B 1/34 52/716.1 |
| 5,584,150 A | * | 12/1996 | Newman | E04C 3/02 52/204.2 |
| 5,653,072 A | | 8/1997 | Seelandt-Stasek et al. | |
| 5,815,986 A | | 10/1998 | Laska | |
| 6,360,500 B1 | | 3/2002 | Wilcox | |
| 6,412,745 B1 | * | 7/2002 | Yokoyama | A47B 95/00 248/247 |
| 6,889,474 B2 | | 5/2005 | Wesdock | |
| 6,964,136 B2 | | 11/2005 | Collins et al. | |
| 10,428,519 B2 | | 10/2019 | Divito et al. | |
| 2005/0210787 A1 | | 9/2005 | Koester | |
| 2005/0284045 A1 | | 12/2005 | Smith | |

FOREIGN PATENT DOCUMENTS

| | | |
|---|---|---|
| CA | 2926843 A1 | 10/2017 |
| GB | 2118585 A | 11/1983 |

OTHER PUBLICATIONS

CIPO Examination Report dated May 9, 2018, issued in corresponding Canadian Application No. 2926843, filed Apr. 11, 2016, 3 pages.
"Lintel Soffit Cladding—Type RC and FC," Catnic a Tata Steel Enterprise, <http://www.catnic.com> [retrieved Jan. 2015], 1 page.

* cited by examiner

*Primary Examiner* — Patrick J Maestri
(74) *Attorney, Agent, or Firm* — Christensen O'Connor Johnson Kindness, PLLC

(57) ABSTRACT

A lintel cover is installable on a lintel to protect the lintel from exposure to the elements and moisture. The lintel cover has an upper surface, side surface, lower surface and lip. The lip is preferably shorter than the height of an upper portion of the lintel to increase the ease of installation.

8 Claims, 3 Drawing Sheets

LINTEL COVER

TECHNICAL FIELD

Coverings for Lintels

BACKGROUND

Steel lintels, also known as angle irons, are utilized to support the weight of materials like bricks or masonry blocks above openings of structures or buildings, including above windows, garages and doors. Over time exposed portions of the lintel oxidizes resulting in an unsightly appearance. Coverings may be used to protect the exposed surfaces of the lintel from the effects of exposure such as weathering and corrosion.

An angle iron cover such as disclosed in U.S. Pat. No. 5,584,150 may provide for an aesthetic covering, but it can cause issues with water pooling since water may leak into the structure or can be retained within the angle iron cover. Over time, water exposure can lead to oxidation of the steel lintel and damage to the structure.

Canadian Patent No. 2,926,843 discloses a lintel cover having a flap and hinge bend to form a sealed air space at a location between the structure and the steel lintel. This design may be cumbersome to install.

Many existing coverings require regular maintenance or are cumbersome to install. There is a need for an aesthetic covering which is easy to install and requires little maintenance, which may be used with existing building material to create complete coverage of a lintel.

SUMMARY

In an embodiment there is provided a cover for a lintel, the lintel having an upper portion and a lower portion, the upper portion generally perpendicular to the lower portion. The cover comprises an upper surface and a lower surface. A side surface connects the upper surface and lower surface at one edge of the upper and lower surface, the upper surface, lower surface and side surface covering the lower portion of the lintel. A lip extends from an opposite edge of the upper surface adjacent to the upper portion, the height of the lip being less than the height of the upper portion of the lintel.

There is also provided a method of installing a cover for a lintel, comprising the steps of placing the cover on the lintel so the cover covers a portion of the lintel over a structural opening and placing a flexible covering over the lintel so the flexible covering partially overlaps the cover.

In various embodiments, there may be included any one or more of the following features: the upper surface is generally parallel to the lower surface and the side surface is generally parallel to the lip, and the upper surface and lower surfaces are generally perpendicular to the lower surface and the side surface; the lip extends up less than half of the height of the upper portion of the lintel; the height of the lip is between half an inch to one inch; the flexible covering further comprises a flashing covering over the lintel so the flashing partially overlaps both the lip of the cover and a structure behind the lintel; and placing tar paper over the flashing so the tar paper partially overlaps the flashing.

These and other aspects of the device and method are set out in the claims.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims.

Figure 1:
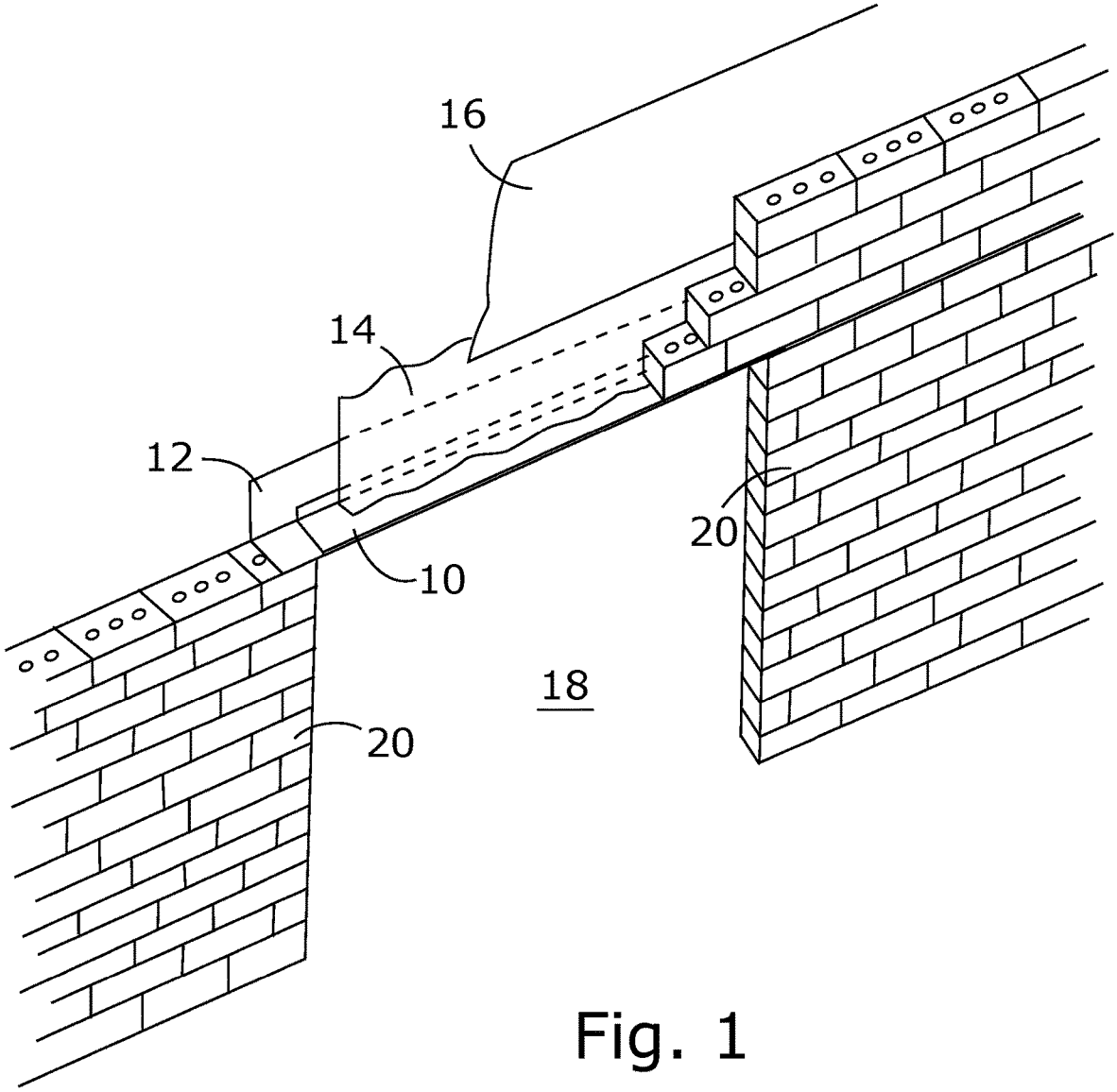
FIG. 1 is a perspective view of an installed lintel covering, shown in environment.
Figure 2:
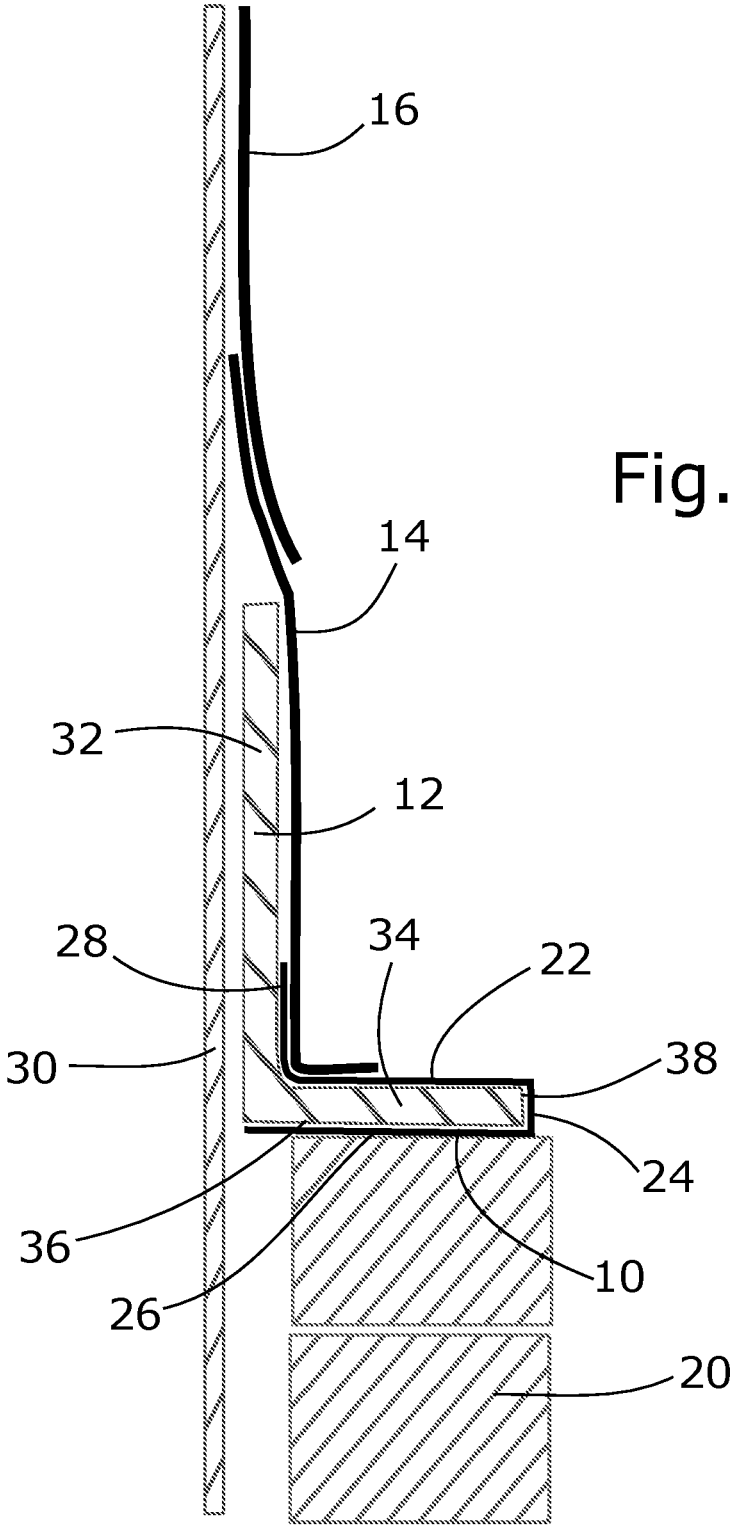
FIG. 2 is a cross section of the installed lintel covering of FIG. 1.
Figure 3:
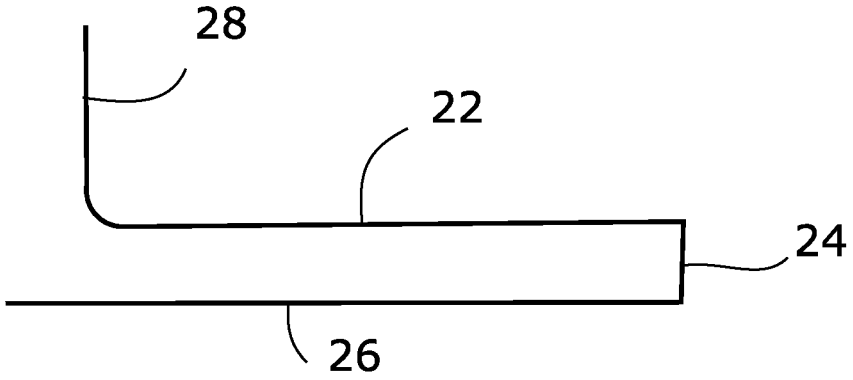
FIG. 3 is a cross section of the lintel covering of FIG. 1.

Lintel covers protect the exposed faces of a lintel from the elements. Typically, when a lintel is installed over an opening of a structure the front face and underside of the lintel are exposed to the elements and may rust over time. Furthermore, water may leak behind the steel lintel or pool on or around the steel lintel and between the structure and the outer wall, causing potential for water damage to the building. Ideally, the covers work to divert moisture over the lintel and away from the structure face, preventing the oxidation of the steel lintel. As shown in FIGS. 1-3, a lintel cover 10 diverts moisture over the lintel 12 and away from the structure face, preventing the oxidation of the steel lintel, and providing an aesthetic covering.

As shown in FIG. 2, steel lintel 12 may be generally L shaped with an upper portion 32 and lower portion 34, where the bottom face 36 and front face 38 of the lower portion 34 are exposed. The lintel cover 10 is installable on a lintel, and is designed to cover at least the portion of the lintel that may be exposed. Once the linter cover 10 is installed within the wall 20 and the brick is laid, the lintel cover forms a permanent part of the wall. The lintel cover is comprised of four surfaces, two of which may be vertical and two of which may be horizontal when installed. As shown in FIG. 3, lintel cover 10 has an upper surface 22, a side surface 24, a lower surface 26 and a top surface or lip 28. The lower surface of lintel cover 10 covers the exposed bottom face of the steel lintel providing an aesthetic covering. The side surface 24 covers the front face 38. Lip 28 and the upper surface 22 of the lintel cover 10 act to provide continuous coverage of the lintel allowing moisture to be diverted away from the structure. The upper surface 22, side surface 24 and lower surface 26 create an over-under component that can slide over the lower, horizontal component of steel lintels. In particular, the upper surface 22, lower surface 26 and side surface 24 cover the lower portion 34 of the lintel. The cover 10 preferably covers the lintel 12 with a tight fit. Upper surface 22 may be generally parallel to the lower surface 26, and side surface 24 may be generally parallel to lip 28. Upper surface 22 and lower surface 26 may be generally perpendicular to side surface 24 and lip 28. The lip 28 provides a surface for a flexible covering of housing materials to be draped over, such as for example polyethylene flashing and tar paper.

FIG. 1 shows an installed lintel cover 10 shown from the front face of a brick wall 20. The steel lintel 12 supports the wall 20 above an opening 18 such as a window or a door. The lip of the lintel cover 10 extends partially along the upper portion 32 of the L shaped lintel 12. The lower edge of a flashing 14 overlaps the lintel cover 10, and a lower edge of tar paper 16 overlaps the flashing 14, as shown in FIG. 2. This layering of the lintel cover 10, and flexible covering, including flashing 14 and finally tar paper 16 utilizes a shingling pattern similar to roofing shingles to create continuous coverage of the steel lintel and to divert moisture away from a structure 30, to prevent moisture from pooling on the lintel. The flashing 14 and tar paper 16 provide a flexible covering to prevent moisture from entering past the lintel cover over the lip 28. Continuous coverage also helps to prevent moisture entering the space between the bricks 20 and structure 30, where it may pool on the lintel or other structures. Structure 30 may be for example a wall of a building or house. The overlapping layers may be sealed together using common construction sealing means, for example tape. Various different types of known tapes can be used.

Lip 28 extends partially up the upper portion 32 of the lintel. The height of the lip 28 is preferably less than the height of the upper portion 32 of the lintel 12 to increase the ease of installation of the lintel cover 10 and may be substantially shorter than the height of the upper portion 32, for example less than half the height of the upper portion 32. The lip 28 extends far enough up the lintel to create complete coverage of the lintel by allowing protective building materials to overlap the lintel cover. In this way, the lip 28 functions as an upper lip which provides for a vertical surface to overlap with flashing. Using a lintel cover with a lip shorter than the lintel's upper portion helps the lintel cover be easier to install and saves on material costs. The lintel cover 10 allows for the flashing to be attached to the upper lip 28 which may allow for complete coverage and for water to be funneled over and away from the lintel and therefore the structure as well.

The lip 28 that extends partially up the upper portion 32 of the lintel is useful to limit or stop moisture from entering the structure from the upper surface 22 of the lintel cover 10. Although the amount of moisture that would otherwise accumulate behind the brick may be minimal, without the lip 28, moisture and water would make its way back into the structure and eventually make its way between the cover and the lintel which over time would cause deterioration and could eventually lead to failure. Even a very small lip 28 may stop the brunt of the water. However, if the lip is not of sufficient height, there is a risk that water may flow up or around the plastic flashing and back down in between the cover and the lintel. Wind may also be an issue, particularly on a third or fourth level scaffold, and so if the lip is of an insufficient height, it may be difficult to keep the plastic/tar paper flashing in front of the lip throughout the length of the lintel. A balance must be made between having a lip that is too long and therefore cumbersome and redundant, as compared to one that is too short and does not provide sufficient protection from moisture or does not allow a structure for the plastic/tar paper to secure against. Preferably, the lip may extend no more than one inch in height. For example, the lip may extend a height between half an inch to one inch.

Certain lintel covers with complicated flaps and joints may be annoying for workers to install because they need to be manipulated in order to be installed correctly. In cases where the lintel covers require manipulation by the workers in order to get into a proper position, sometimes the worker may forget to do whatever manipulation is required, which may lead to the lintel cover hitting the structure and both the cover and lintel may not sit properly on the brick or over the window.

Providing a lip with minimal height may provide multiple benefits, including making the lintel cover easier to cut, handle, and install. A lintel cover with a minimal height lip sits on the steel lintel better and can be kept in position by workers such as masons well placed on the lintel as bricks are being installed. By keeping weight and size to a minimum, shipping costs and the amount of storage space required are reduced.

The lip 28 is configured to be integrated with existing or new building material to create complete coverage of the lintel from the elements. The building materials may be any material used to create a barrier to protect the structure, for example flashing, tar paper or house wrap, alone or in combination. The flashing may be for example polyethylene flashing. Other types of materials may be used to construct the flashing. Preferably, the flashing is made from a durable, lightweight and waterproof material. Lintel cover 10 may be used with any house wrap. The house wrap may be for example Tyvek™ HomeWrap™.

The lintel cover 10 preferably extends long enough to cover the entire exposed surface of the lintel 12, for example at least the width of the structural opening.

The lintel cover 10 is preferably manufactured for a precise fit on the lintel, and with a thickness chosen so the cover does not substantially interfere with the structural elements of the building or the surrounding materials.

The components may be installed over each other starting from the bottom, allowing water to be diverted away from the structure. Lintel cover 10 is designed to be relatively compact so that it may be quickly and easily installed. To install the lintel cover 10 it is slid over the steel lintel 12 creating over-under coverage. The flexible covering such as polyethylene flashing 14 may then be draped over the lip 28 of the lintel cover, followed by tar paper 16 draped over the polyethylene flashing 14, ensuring each layer at least partially overlaps with at least the layer immediately below it. Bricks or other wall material may then be placed on the upper surface of the lintel cover. Installing a lintel with a lip 28 that extends partially up the upper portion 32 of the lintel, may allow for substantially easier installation for workers than if more complicated structures of lintel covers are used. Moreover, the lintel cover is compact and easy to handle and can be installed using available construction materials. This can create time and cost savings.

The exterior brick wall shown in FIG. 1 is shown for example only. The wall or structure may be other masonry blocks or other construction materials. References to bricks includes other construction materials. Use of the term "lintel" or "steel lintel" refers to any horizontal structural support that spans an opening between two vertical supports. Lintels are often made of steel but may be made of other materials. The use of the term "brick" can refer to any rectangular units of clay or other material used in a building to make a wall or other vertical structure.

In a preferred embodiment, the lintel cover is extruded out of PVC with added stabilizers.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A cover for a lintel, the lintel having an upper portion and a lower portion, the upper portion generally perpendicular to the lower portion, the cover comprising:

an upper surface and a lower surface;

a side surface connecting the upper surface and lower surface at one edge of the upper and lower surface, the upper surface, lower surface and side surface configured to cover the lower portion of the lintel;

and a lip extending from an opposite edge of the upper surface adjacent to the upper portion, wherein the height of the lip is less than five inches.

2. The cover of claim 1 in which the upper surface is generally parallel to the lower surface and the side surface is generally parallel to the lip, and the upper surface and lower surface are each generally perpendicular to the side surface.

3. The cover of claim 1 in which the height of the lip is less than two and a half inches.

4. The cover of claim 3 in which the height of the lip is between half an inch to one inch.

5. A method of installing the cover of claim 1, comprising the steps of:

placing the cover on the lintel so the cover covers a portion of the lintel over a structural opening;

placing a flexible covering over the lintel so the flexible covering partially overlaps both the lip of the cover and a structure behind the lintel.

6. The method of claim 5 in which the flexible covering further comprises a flashing covering over the lintel so the flashing partially overlaps the lip of the cover.

7. The method of claim 6 in which the flexible covering further comprises tar paper and the tar paper is placed over the flashing so the tar paper partially overlaps the flashing.

8. The method of claim 5 in which the cover is manufactured to provide a fit with negative tolerance between the upper surface and the lower surface and the lower portion of the lintel when installed.

* * * * *